US005649776A

United States Patent [19]

Sugimoto et al.

[11] Patent Number: 5,649,776

[45] Date of Patent: Jul. 22, 1997

[54] PAPER DISCHARGE APPARATUS

[75] Inventors: Ryotaro Sugimoto; Tadashi Nonaka; Hideo Kanbe; Kanji Suzuki, all of Shizuoka, Japan

[73] Assignee: Star Micronics Co., Ltd., Shizuoka-ken, Japan

[21] Appl. No.: 574,296

[22] Filed: Dec. 18, 1995

[30] Foreign Application Priority Data

Dec. 19, 1994 [JP] Japan ..... 6-334902

[51] Int. Cl.[6] ..... B41J 11/26

[52] U.S. Cl. ..... 400/617; 400/621

[58] Field of Search ..... 400/612, 613, 400/613.1, 617, 619, 621, 642, 578, 593, 602, 603

[56] References Cited

U.S. PATENT DOCUMENTS 4,560,990 12/1985 Sue et al. ..... 400/621

5,115,322 5/1992 Jang ..... 400/621

5,215,393 6/1993 Wincent ..... 400/621

5,478,161 12/1995 Suzuki et al. ..... 400/621

*Primary Examiner*—Eugene H. Eickholt

*Attorney, Agent, or Firm*—Pollock, Vande Sande & Priddy

[57] ABSTRACT

A paper discharge apparatus ensures guiding of paper to be discharged to smoothly perform a paper discharging operation. The paper discharge apparatus ensures guiding of the paper toward paper discharge means when the paper to be discharged to a discharge port is delivered. The paper discharge apparatus provided in a paper discharge portion of a printer for discharging paper comprises discharge means for receiving the paper to be discharged and discharging the paper toward a discharge port, storage means for looping the paper to be discharged and storing the looped paper before when the paper is discharged, and guide means for guiding a leading end of the paper introduced into the storage means to the discharge means, and for promoting the looping of the paper which is looped as the paper is introduced into the storage means.

6 Claims, 14 Drawing Sheets

PAPER DISCHARGE APPARATUS

BACKGROUND OF THE INVENTION

1. Field of the Invention

The present invention relates to a paper discharge apparatus fixed to an equipment such as a printer for use in discharging a continuous recorded paper such as a printed receipt, ticket, etc.

2. Description of the Prior Art

In a conventional printer adapted for use in an issuing apparatus for issuing a printed receipt, ticket, etc., a continuous paper is printed, and the printed paper is cut into pieces of paper each having a given length, and the cut pieces of paper are discharged.

In such a printer, there is a possibility that a recipient picks up paper to be discharged or blocking a discharge port with a hand, which obstructs the discharge of the paper. The following measures are taken for evading such an unexpected paper jam, namely, the paper to be discharged is stored inside the apparatus until completion of printing and cutting of the paper, then the paper is discharged toward the recipient in synchronization with cutting of the paper.

Now, there is an apparatus as disclosed in e.g. Japanese Patent-Laid Open Publication No. 1-181659 as an apparatus for assisting such discharge of the paper. In this apparatus, control of the paper discharge is realized by a mechanical mechanism, which is however complicated in the structure, and maintenance and control of this apparatus are troublesome, which can not be ignored.

If the paper to be handled is a roll paper, curling property of the paper delicately influences upon the discharge of the paper, which causes a possibility that the paper is not discharged smoothly depending on curvature of the paper. To enhance reliability of the paper discharge, a mechanism was large-scaled, which caused problems such as a paper jam and prevented the apparatus from being small-sized.

SUMMARY OF THE INVENTION

It is therefore an object of the invention to provide a paper discharge apparatus for ensuring guiding of paper to be discharged so as to smoothly discharge the paper.

To achieve the above object, a paper discharge apparatus of the present invention ensures guiding of paper toward paper discharge means when the paper to be discharged to a paper discharge port is delivered. In a first aspect of the invention, as exemplified in FIG. 1, the paper discharge apparatus provided in a paper discharge portion of a printer for discharging paper (4) is characterized in comprising discharge means (discharge rollers 38, 42) for receiving the paper (4) to be discharged and discharging the paper (4) toward a discharge port (33), storage means (space portion 34) for looping the paper to be discharged and storing the looped paper therein before the paper is discharged, and guide means (guide piece 30) for guiding a leading end of the paper introduced into the storage means to the discharge means, and for promoting the looping of the paper which is looped as the paper is introduced into the storage means. With such an arrangement, the paper to be discharged is guided by the guide means toward the discharge means, which allows the paper to be favorably delivered to the discharge means. As a result, even such paper that is difficult to be discharged because it is softened or deformed can be easily discharged, which enhances reliability of the paper discharging operation.

In a second aspect of the invention, as exemplified in FIG. 1, a paper discharge apparatus provided in a paper discharge portion of a printer for discharging paper (4) is characterized by comprising a pair of discharge rollers (discharge rollers 38, 42) for receiving the paper to be discharged and discharging the paper, a space portion (34) for storing the paper which is looped by being clamped by the pair of discharge rollers as the paper is delivered therein, and guide means (guide piece 30) for guiding a leading end of the paper introduced into the space portion to the pair of discharge rollers, and for looping the paper inside the space portion when said guide means is deformed depending on the flexure of the paper caused by the delivery of the paper into the space portion. That is, in the paper discharge apparatus, the paper discharged from the printer strikes against the guide means provided inside the space portion at the leading end thereof, and it is then guided by the guide means, and finally delivered to the pair of rollers by feeding force of the paper. When the operation of the pair of rollers are stopped in a state where the pair of rollers hold the leading end of the paper, the paper is bent by the feeding force, and the guide means is deformed depending on the weight of the paper and the feeding force. As a result, the paper is looped and is stored in the space portion. Successively, after the paper is printed and cut off, the pair of discharge rollers are driven. As a result, the paper is discharged by the pair of discharge rollers.

In a third aspect of the invention, a paper discharge apparatus is characterized by including a paper discharge passage for guiding the paper delivered by the pair of discharge rollers. In such a manner, the paper discharge passage is provided at the discharge side of the discharge rollers, so the discharged paper is discharged through the discharge passage.

In a fourth aspect of the invention, there is provided a guide piece (30), as guide means, which is made of elastic material and extends from a portion adjacent to the pair of discharge rollers provided at the paper discharge passage to the space portion, wherein the guide piece receives a leading end of the paper to be delivered thereby, guides the paper to the pair of discharge rollers, and loops the paper clamped by the pair of rollers at the leading end thereof inside the space portion as the guide piece is bent depending on the flexure of the paper caused by the delivery of the paper into the space portion. That is, the guide means is structured in an arbitrary shape. However, there is provided a guide piece which is made of elastic material and protrudes from the pair of discharge rollers toward the space portion as an appropriate means to be deformed depending on the weight of the paper and the feeding force, wherein the guide piece receives the paper to be delivered thereby, guides the leading end of the paper to the pair of discharge rollers, and is deformed depending on the weight of the paper and the feeding force, thereby looping the paper inside the space portion.

In a fifth aspect of the invention, a paper discharge apparatus includes a single or plural guide pieces which are disposed along a paper feed passage. It is a matter of course that the shape and the number of the guide piece can be changed arbitrarily and optimized corresponding to the width of the paper to be discharged. As a result, the paper is surely discharged, which enhances the paper discharging operation.

DETAILED DESCRIPTION OF THE PREFERRED EMBODIMENT

Figure 1:
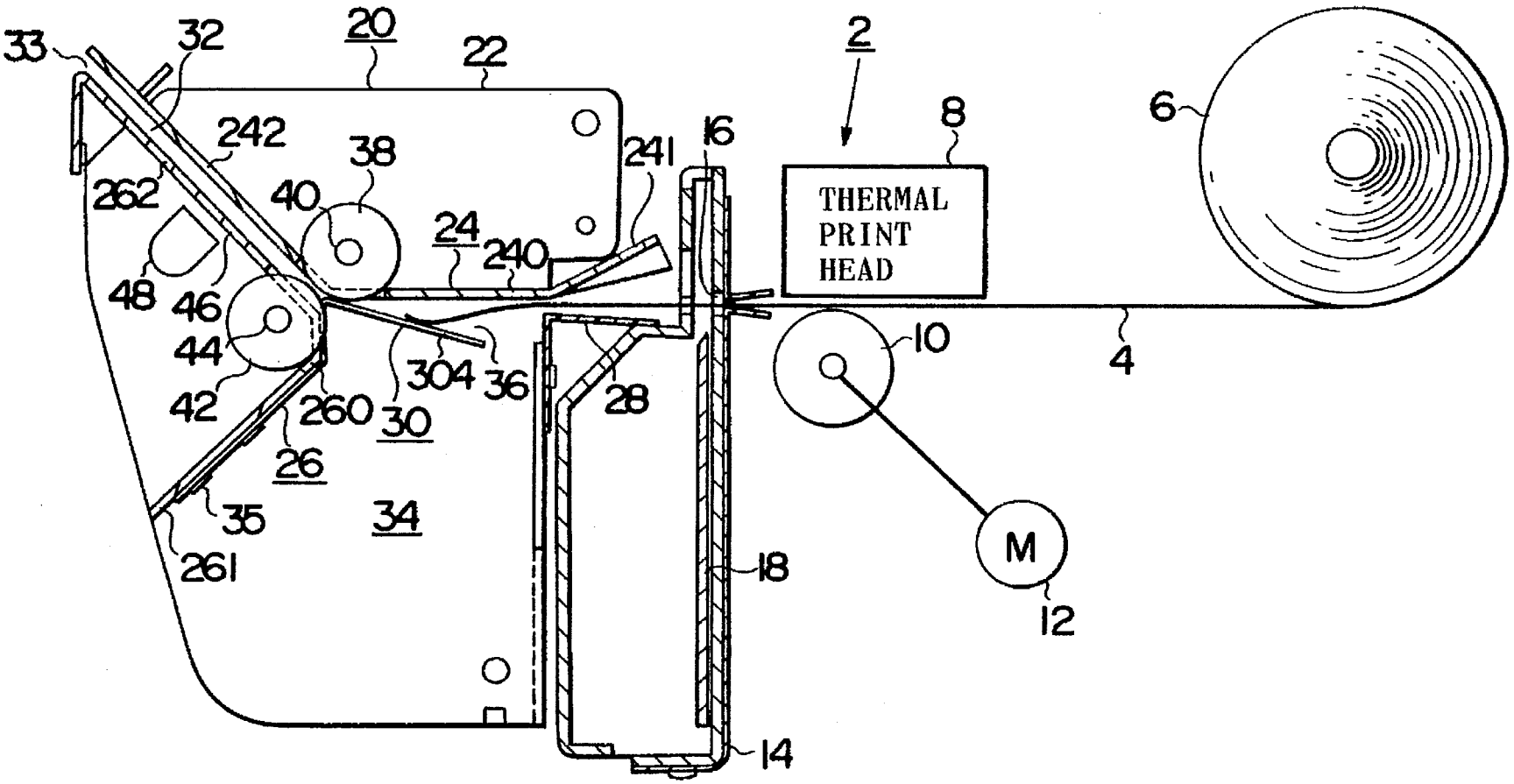
FIG. 1 is a view of a paper discharge apparatus according to a first embodiment of the present invention.

The present invention will be now described more in detail with reference to preferred embodiment as illustrated in the attached drawings.

First Embodiment (FIGS. 1 through 13)

A paper discharge apparatus according to a first embodiment of the present invention will be now described with reference to FIGS. 1 through 13.

In the same figures, a printer 2 is disposed at an upstream of the paper discharge apparatus. Paper 4 is unwound from a roll paper 6 and is fed to a thermal print head 8 of the printer 2 serving as a printing means relative to the paper 4. A platen 10 is disposed at a side of printing surface of the thermal print head 8 while intervening the paper 4 between itself and the thermal print head 8. In the first embodiment, the platen 10 also serves as a feed roller for unwinding the paper 4 from the roll paper 6 and delivering it, and it is connected to a motor 12 serving as a driving means by way of a gear mechanism, not shown.

A cutting apparatus 14 is disposed at a side of a paper discharge portion of the printer 2 as a means for cutting the paper 4 to pieces of paper each having an appropriate length to issue a receipt or a ticket. The cutting apparatus 14 includes a paper feed passage 16 through which the paper 4 passes, and cuts off the paper 4 by allowing a cutter blade 18 to advance to and retract from the paper 4. Such advancing and retracting motion of the cutter blade 18 is carried out by a driving means such as a motor.

The paper discharge apparatus is disposed at the paper discharge portion of the printer 2, and comprises a paper discharge unit 20 in the first embodiment. The paper discharge unit 20 is integrally composed of the printer 2 in the first embodiment, but it may be composed of an independent unit. The paper discharge unit 20 includes a body frame 22 as a body of the paper discharge apparatus. There are disposed in the body frame 22 an upper guide plate 24, a lower guide plate 26 and a guide piece 28 for guiding the paper 4, and a guide piece 30 serving as a guide means for discharging and looping the paper 4.

The upper guide plate 24 includes a flat portion 240 and upwardly directed inclination portions 241 and 242 while intervening the flat portion 240 therebetween. The guide piece 28 is L-shaped and fixed to the body frame 22. The guide piece 28 forms a paper drawing portion together with the inclination portion 241 of the upper guide plate 24 along the paper feed passage 16 while the guide piece 28 makes an acute angle with the inclination portion 241. The inclination portion 241 prevents the paper 4 from jumping while the guide piece 28 prevents the paper 4 from dropping.

The lower guide plate 26 has inclination portions 261 and 262 which cross each other at substantially 90° while intervening a curved portion 260. The inclination portion 262 is arranged in parallel with the inclination portion 242 of the upper guide plate 24, and a paper discharge passage 32 is defined between the inclination portion 262 and the inclination portion 242, and a paper discharge port 33 is formed at a terminal end of the paper discharge passage 32.

Figure 2:
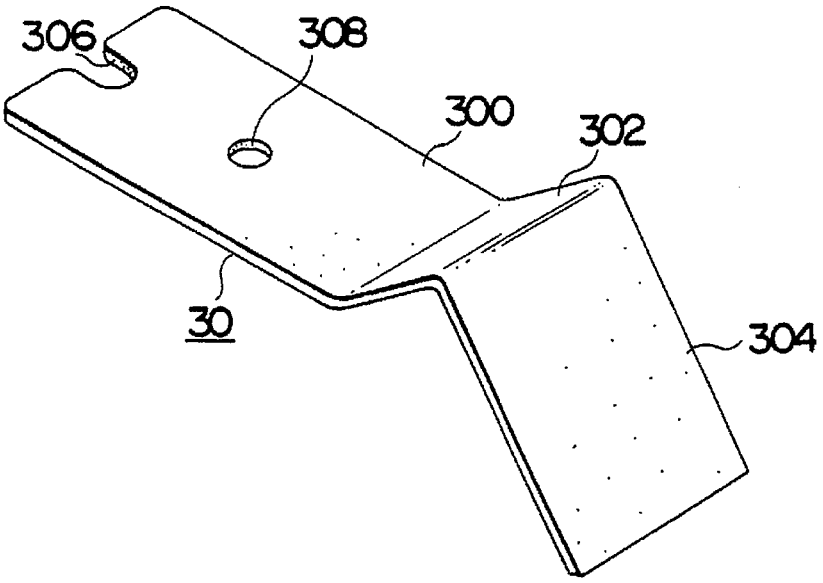
FIG. 2 is a perspective view showing an example of a guide piece.

With such relation of the disposition, a space portion 34 as a storage means is provided under the flat portion 240 of the upper guide plate 24 for storing therein the paper 4 to be discharged. A surface for fixing the guide piece 30 extends from the curved portion 260 of the lower guide plate 26 to the inclination portion 261, and the guide piece 30 is fixed to the fixing surface by a fixing means such as a screw 35 or a pressure sensitive adhesive double coated tape. The guide piece 30 is formed of an elastic plate made of a synthetic resin plate or a thin metallic plate. As shown in FIG. 2, the guide piece 30 comprises an L-shaped fixed portion 300 extending from the curved portion 260 to the inclination portion 261 of the lower guide plate 26 and including an inclination portion 302 continuously extending from the fixed portion 300, and a guide portion 304 extending continuously from the inclination portion 302 and forming an inclination surface which is bendable relative to the inclination portion 302. The fixed portion 300 has a U-shaped notch 306 at the end portion thereof and a through hole 308 at the middle portion thereof for the convenience of fixing by the screw 35, etc., namely, it is fixed by the screw 35, etc. through the notch 306 and the through hole 308. The guide piece 30 fixed to the lower guide plate 26 defines a paper discharge guide passage 36 while the guide portion 304 makes an obtuse angle with respect to the inclination surface of the inclination portion 262 and makes an acute angle with respect to the flat portion 240.

Discharge rollers 38 are supported by a driving shaft 40 at a bent portion of the inclination portion 242 of the upper guide plate 24. Discharge rollers 42 are supported by a supporting shaft 44 at the curved portion 260 of the lower guide plate 26, thereby forming two pairs of rollers 38 and 42.

A window 46 is defined in the inclination portion 262 of the lower guide plate 26, and a paper sensor 48 is provided for detecting the paper 4, which arrives at or passes through the paper discharge passage 32, through the window 46. The paper sensor 48 comprises, e.g., a photosensor for detecting presence or non-presence of the paper 4 by reflection or interruption of light, and outputs an electric signal representing presence or non-presence of the paper 4.

Figure 3:
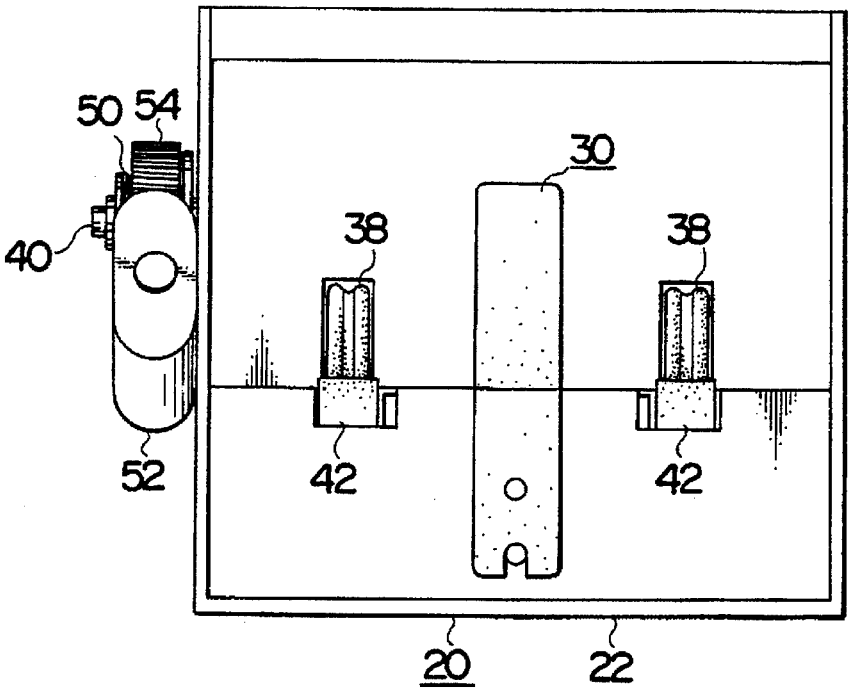
FIG. 3 is a rear view of the paper discharge apparatus in FIG. 1.
Figure 4:
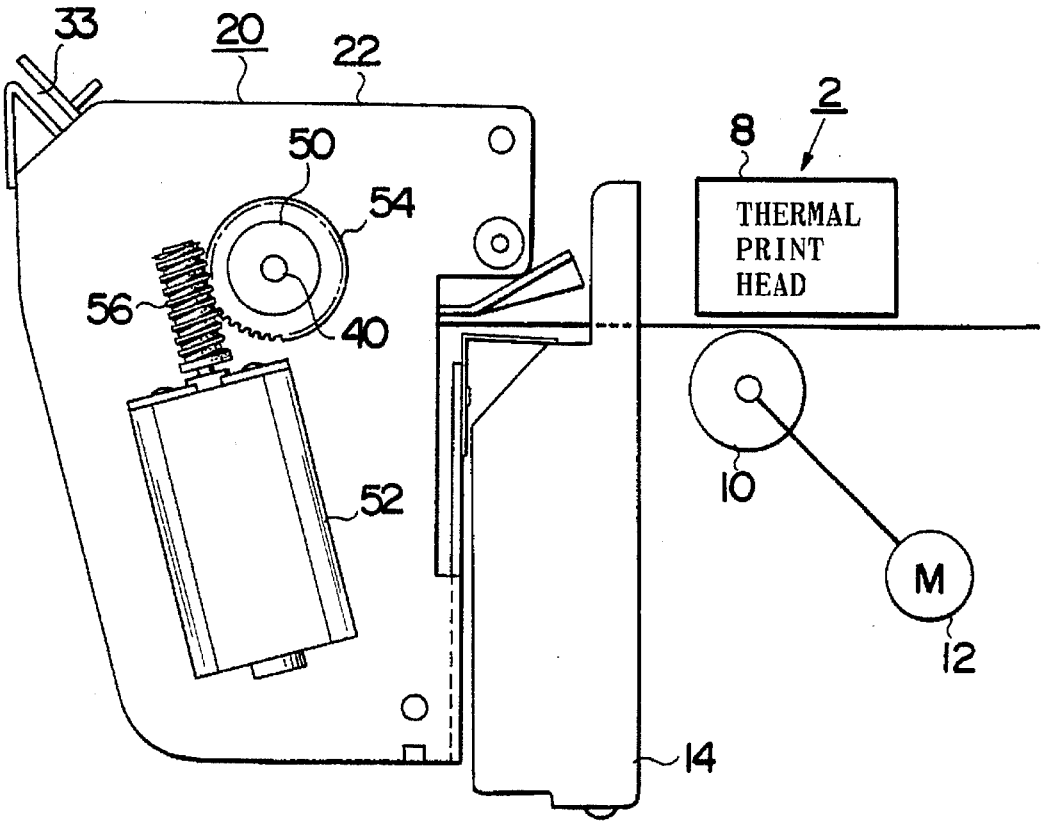
FIG. 4 is a side view of the paper discharge apparatus in FIG. 1.

FIG. 3 shows a structure of the paper discharge unit 20 viewing from a back surface thereof, and FIG. 4 shows a structure of the paper discharge unit 20 viewing from the side surface thereof. There are provided a plurality of discharge rollers 38, and the guide piece 30 is disposed between the discharge rollers 38. A torque limiter 50 is fixed to the driving shaft 40 of the discharge rollers 38 as a gear mechanism. Torque of a motor 52 as a driving means fixed to the body frame 22 is transmitted to the torque limiter 50. A gear 56 meshes a gear 54 of the torque limiter 50 to transmit torque of the motor 52 to the torque limiter 50. Accordingly, torque of the motor 52 is transmitted to the discharge rollers 38 by way of these gear mechanisms.

Figure 5:
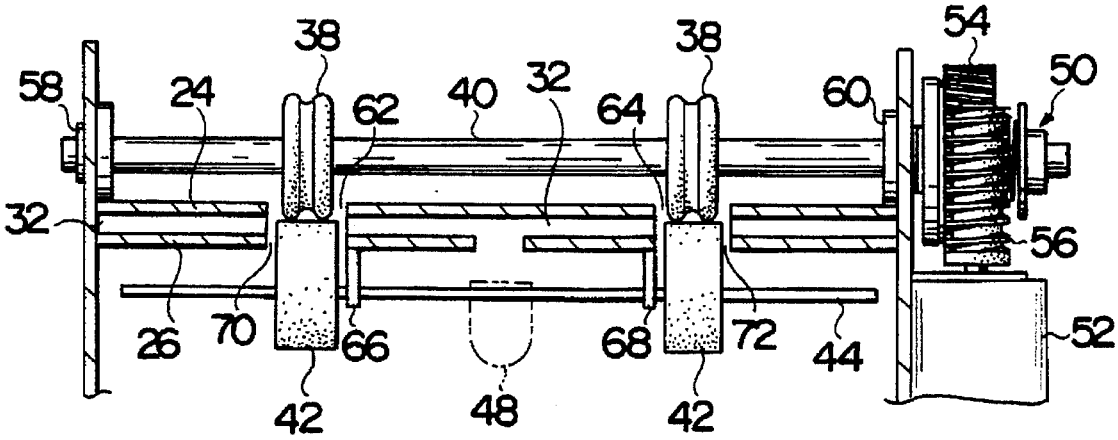
FIG. 5 is a view showing a driving system of discharge rollers.

FIG. 5 shows a driving system of the discharge rollers 38 and the driving shaft 40. The driving shaft 40 of the discharge rollers 38 is supported by bearings 58 and 60. Windows 62 and 64 corresponding to the discharge rollers 38 are defined in the upper guide plate 24. The discharge rollers 38 protrude from the windows 62 and 64, and surfaces of the discharge rollers 38 contact surfaces of the discharge rollers 42 by way of the paper 4. The discharge rollers 42 are supported by the supporting shaft 44 which is formed of an elastic metallic shaft. The supporting shaft 44 is supported by bearing portions 66 and 68 fixed to the lower guide plate 26. Windows 70 and 72 are defined in the lower guide plate 26 relative to the discharge rollers 42, and surfaces of the discharge rollers 42 contact the discharge rollers 38 with appropriate resiliency.

Figure 6:
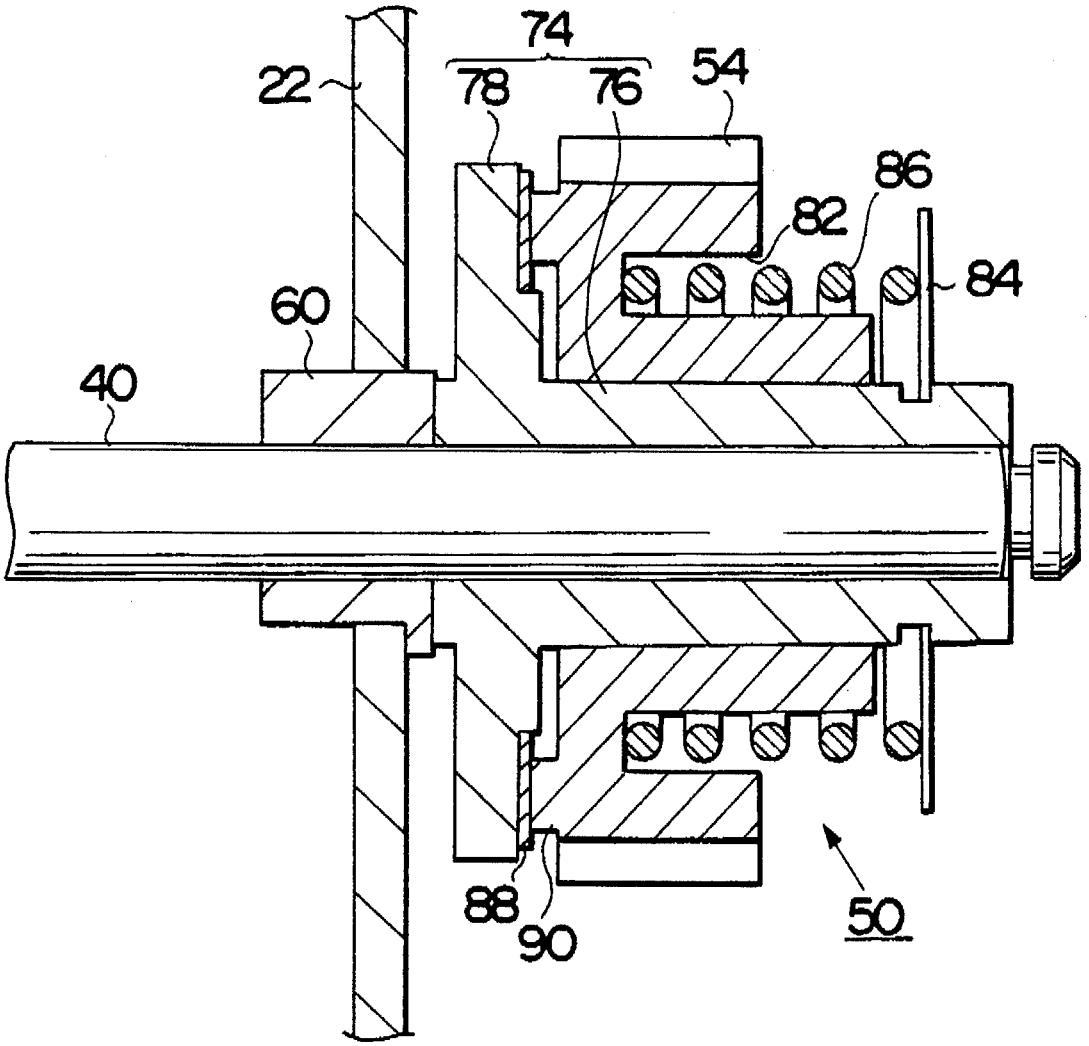
FIG. 6 is a longitudinal cross-sectional view of a torque limiter.

FIG. 6 shows a concrete structure of the torque limiter 50. The driving shaft 40 of the discharge rollers 38 is supported by the body frame 22 by way of the bearings 60, and protrude outside the body frame 22. A clutch portion 74 is fixed to the driving shaft 40. The clutch portion 74 includes a small diameter portion 76 and a flange portion 78 wherein the gear 54 is rotatably provided on the small diameter portion 76. A recess 82 is defined in the gear 54 in the axial direction thereof. A coil spring 86 is inserted between the recess 82 and a discoidal spring receiver 84 fixed to the small diameter portion 76 for pressing the gear 54 against a wall surface of the flange portion 78. A slip member 88 is attached to the flange portion 78 of the clutch portion 74, and a ring-shaped contact portion 90 of the gear 54 is pressed against the slip member 88 by pressure of the coil spring 86.

In such a torque limiter 50, the gear 54 is frictionally engaged with the clutch portion 74 by pressure of the coil spring 86 at a normal time when the torque of the motor 52 is transmitted from the gear 56 to the gear 54, whereby the rotation of the gear 54 is transmitted to the driving shaft 40.

Meanwhile, when a force to prevent the rotation influences upon the driving shaft 40 by way of the discharge rollers 38, and this force exceeds pressing force of the coil spring 86 and a frictional force between the clutch portion 74 and the contact portion 90 of the gear 54, the gear 54 idles to prevent the torque to be transmitted to the driving shaft 40, thereby preventing a discharge of the paper 4 by the discharge rollers 38. In other words, when the discharge of the paper 4 is obstructed, stress generated thereby is applied to the driving shaft 40 by way of the paper 4, thereby idling the gear 54.

Figure 7:
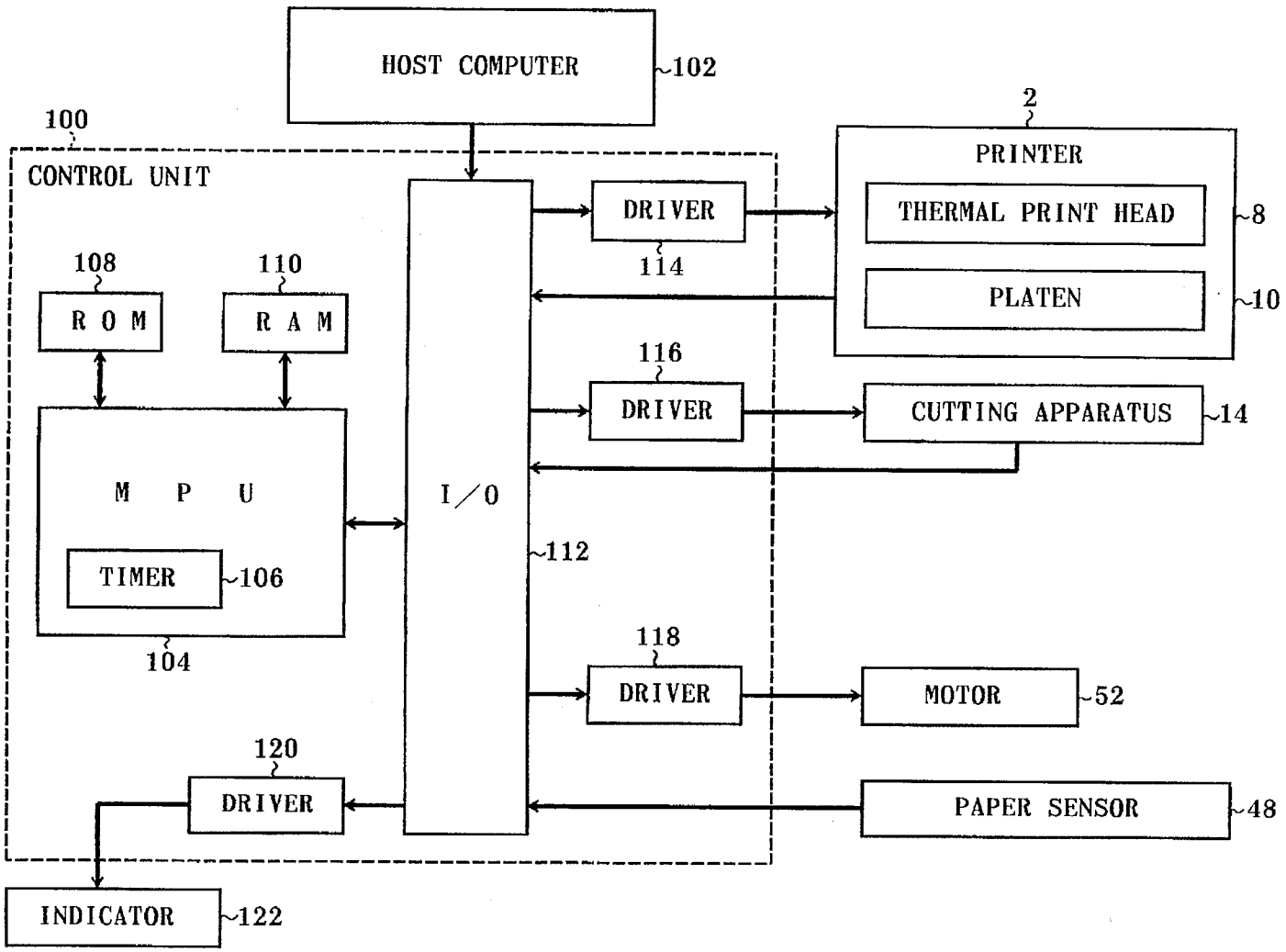
FIG. 7 is a block diagram of a control unit of the paper discharge apparatus.

FIG. 7 shows an arrangement of a control unit of an issuing apparatus. The control unit includes a control portion 100 for controlling the feeding operation, the printing operation, the paper cutting operation and the paper discharging operation. According to the first embodiment, the printing operation and the paper discharging operation are controlled by the single control portion 100 but they may be controlled individually.

The control portion 100 comprises, e.g., a microcomputer for communicating with a host computer 102 and executing various controls. A microprocessor unit (MPU) 104 as a central processing unit controls various operations such as the feeding operation, the printing operation, the paper cutting operation and the paper discharging operation and also performs an arithmetic operation in accordance with a program. The MPU 104 includes a timer 106 as a means for setting and controlling time.

The control portion 100 includes a ROM 108 and a RAM 110 as a main memory means for storing therein a control program to be executed by the MPU 104, a control data and data under processing, etc. The ROM 108 is a read only memory having a control program, a table, etc., and the RAM 110 is a random access memory for storing data under processing, etc. It is possible to employ a memory medium such as a flexible diskette, etc. as an auxiliary storing means, not shown, instead of the RAM 110. A storing means attached to the host computer 102 can be also used as the auxiliary storing means of the control portion 100.

The control portion 100 also includes an input/output unit (I/O) 112 for receiving input data from the host computer 102 or supplying a control output. The I/O 112 is connected to the MPU 104, the ROM 108 and the RAM 110 by way of a bus. The I/O 112 is connected to a switch and the like through which an on-line operation instruction from the host computer 102 is input to the I/O 112 but such switch and the like are omitted since they are not directly related to the control of the paper discharging operation of the invention.

The I/O 112 is connected to first, second, third and fourth drivers 114, 116, 118 and 120 serving as a means for supplying the control output to various components. The first driver 114 is a driving output means for supplying a driving output necessary for printing to the printer 2, and the second driver 116 is a driving output means for supplying a driving output necessary for cutting to the cutting apparatus 14 while the third driver 118 is a driving output means for supplying a driving output necessary for discharging the paper 4 to the motor 26, and the fourth driver 120 is a driving output means for supplying a driving output necessary for indicating error to an indicator 122.

The printer 2 is provided with the thermal print head 8 and the platen 10. The platen 10 is a means for delivering the paper 4 to be printed and for supporting the paper 4 during printing, and it comprises feed rollers, etc. for receiving torque of the motor 12 rotating in synchronization with the printing operation. The thermal print head 8 prints the paper 4 based on the printing data from the host computer 102.

Described hereinafter is each of the feeding operation, the printing operation, the paper cutting operation and the paper discharging operation.

Figure 8:
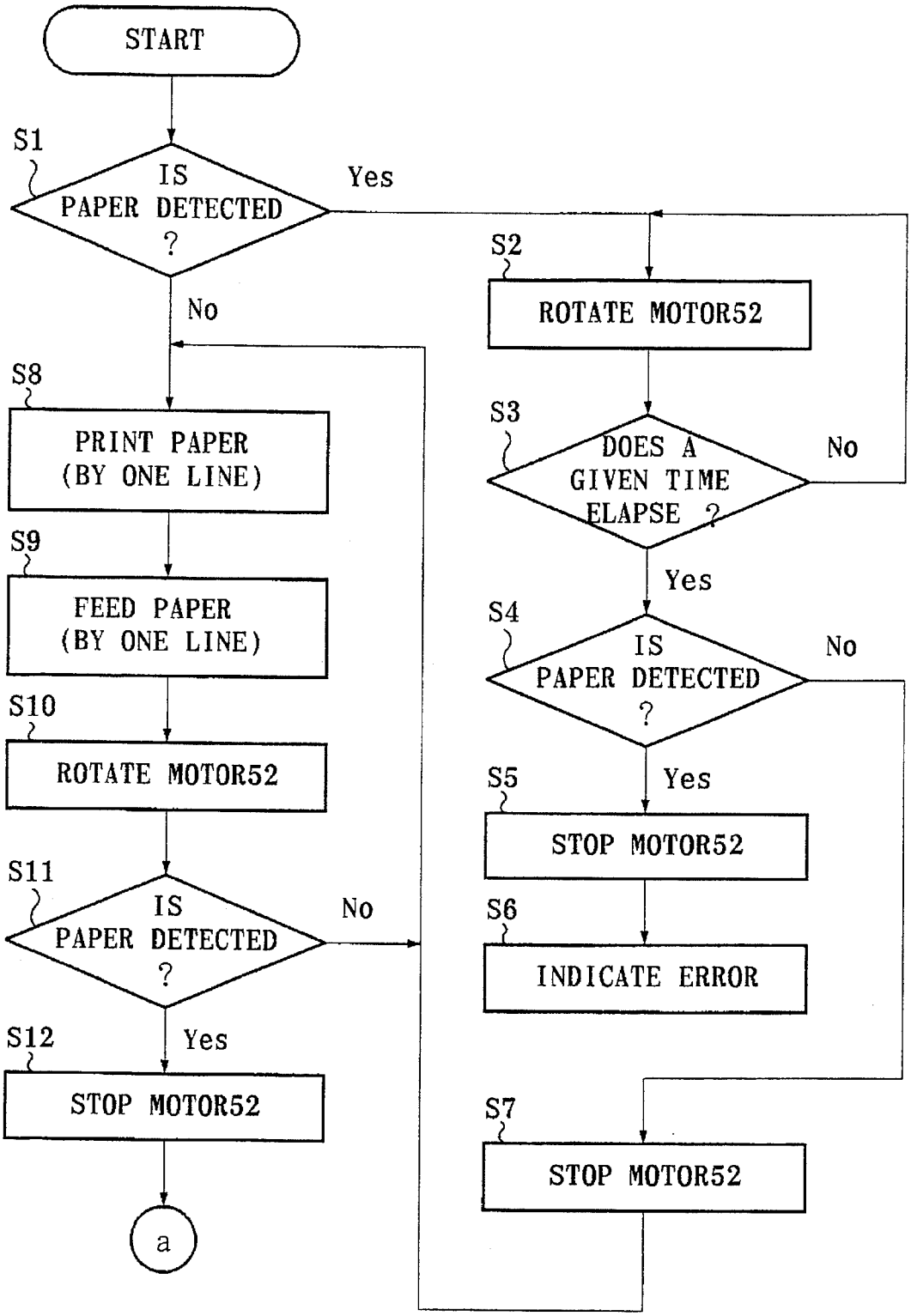
FIG. 8 is a flow chart showing a control program of printing and paper discharging operations.
Figure 9:
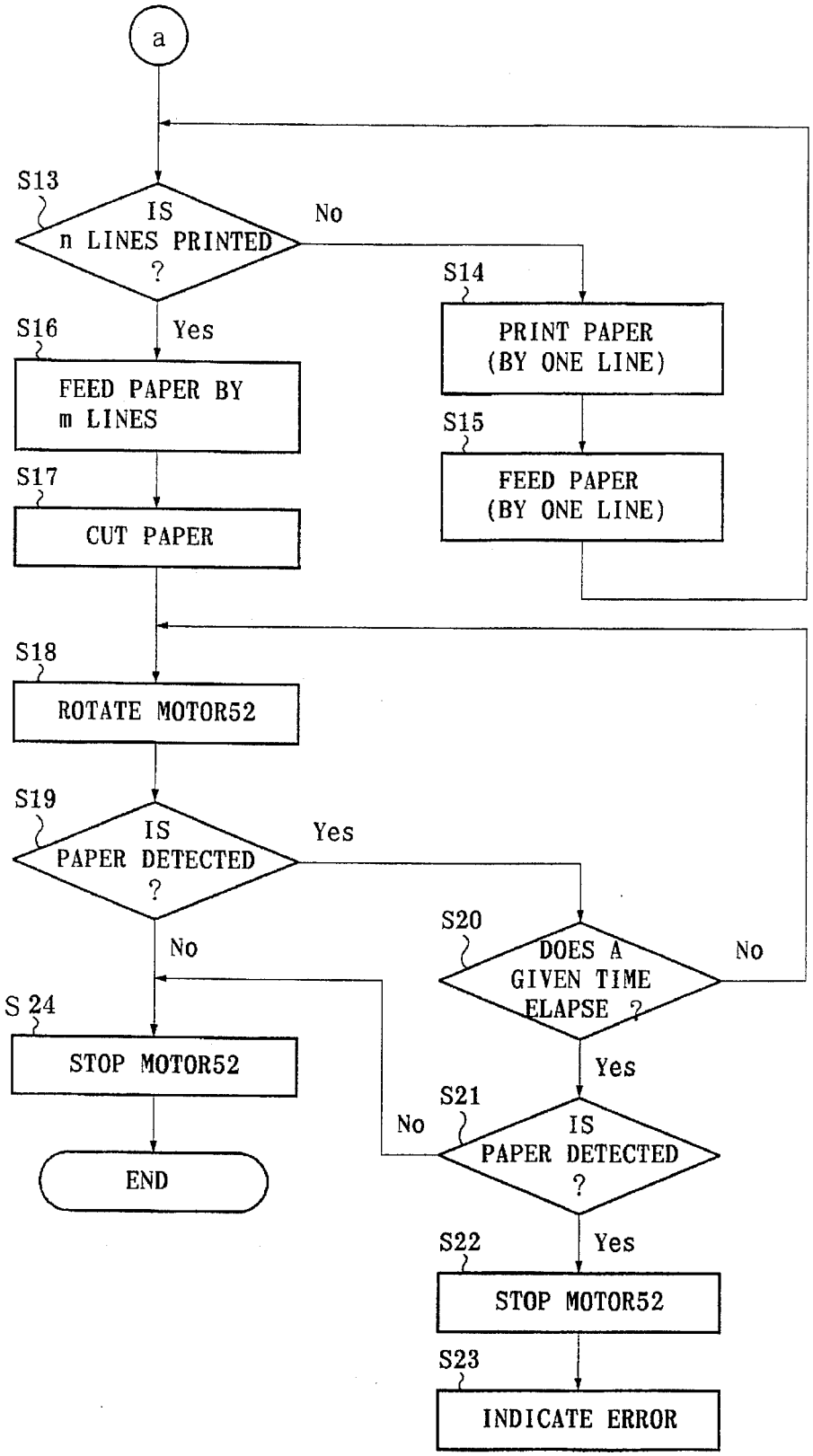
FIG. 9 is another flow chart showing a control program of printing and paper discharging operations.

FIGS. 8 and 9 show a program showing the feeding operation, the printing operation, the paper cutting operation and the paper discharging operation, in which denoted at "a" represents connecting symbols.

First, the control portion 100 is initialized when it receives power supply or it is reset by pressing a reset switch, then the feeding operation and the printing operation are performed at the same time. The printed paper 4 passes through the paper feed passage 16 of the cutting apparatus 14, and it is guided toward the paper discharge unit 20, and the leading end of the printed paper 4 reaches the guide piece 30. At this time, the guide piece 30 receives the leading end of the printed paper 4 with its resiliency and guides it toward the discharge rollers 38 and 42. Then, the paper 4 is cut off in a given length and successively it is discharged.

In step S1, the paper detection sensor 48 detects the paper 20. If the paper 4 is detected, the program goes to step S2 where the motor 52 is rotated for discharging the cut paper 4.

In step S3, the control portion 100 measures a driving time of the motor 52 counting from the start of the driving and judges as to whether a given time elapses or not. If a given time does not elapse, the program returns to step S2. As a result, the motor 52 keeps to drive for a given time and feeds the paper 4 for a given time.

In step S4, the paper detection sensor 48 detects again the paper 4. If the paper 4 is detected, the program goes to step S5 where the motor 52 is stopped and it goes to step S6. In step S6, it is apparent that error occurs so that the indicator 122 is lighted to thereby indicate the error. By the indication of the error, anomaly of the feeding operation such as an occurrence of paper jam can be informed to a recipient.

If the paper 4 is not detected in step S4, the program goes to step S7 where the rotation of the motor 52 is stopped and it goes to step S8 where the printing operation is performed. In step S8, the paper is printed by one line and in step S9, the paper is fed by one line. This feeding operation is a line feed operation corresponding to a line printing. In step S10, the motor 52 is rotated so that the paper discharging operation starts.

In step S11, the paper detecting operation is performed again, and if the paper 4 is not detected, the program returns to step S8. If the paper 4 is detected, the program goes to step S12 where the rotation of the motor 52 is stopped. In step S13, the control portion 100 judges as to whether n lines printing has been performed or not. If n lines printing is not performed, the program goes to step S14 where one line printing is performed. In step S15, a line feed by one line is performed and the program returns to step S13. In step S13, when the n lines printing is completed, i.e., upon completion of printing, the program goes to step S16 where the line feed of the paper 4 by m lines is performed for preparing the paper cutting operation and this feeding operation can be performed by the platen 10.

In step S17, the paper 4 is cut off and the program goes to step S18. In step S18, the discharging operation of the paper 4 starts and the motor 52 is rotated. In step S19, the paper detecting operation is performed, and if the paper 4 is detected, the program goes to step S20. In step S20, the control portion 100 judges as to whether a given time elapses starting from the detection of the paper 4. If a given time does not elapse, the program returns to step S18 where the operations in steps S18 and S19 are executed. If the control portion 100 judges that a given time has elapsed in step 20, the program goes to step S21 where the paper detecting operation is performed. If the paper 4 is detected in step S21, the program goes to step S22 where the rotation of the motor 52 is stopped and the program goes to step S23 where the indicator 122 indicates error.

If the paper 4 is not detected, namely, when the paper 4 is discharged and the sensor 48 detects the discharge of the paper 4, the program goes to step S24 where the rotation of the motor 52 is stopped. When the rotation of the motor 52 is stopped, the paper discharging operation is completed and the control portion 100 enters into a standby state.

Figure 10:
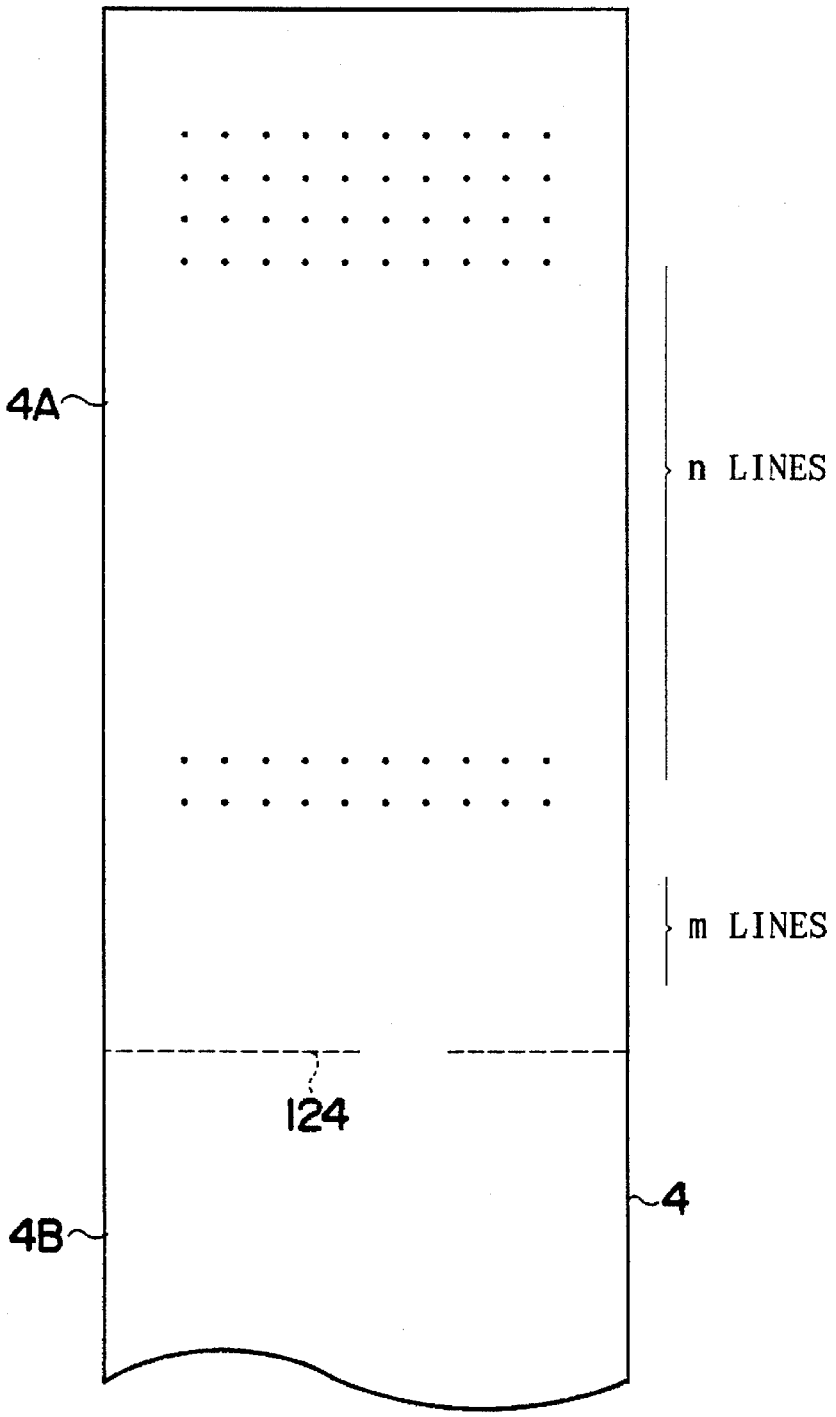
FIG. 10 is a plan view of paper.

FIG. 10 shows printing of the paper 4 by n lines and line feeding of the paper 4 by m lines respectively in steps S8 through S16 wherein a broken line 124 represents a cutting position. A cut portion 4A of the paper 4 which was cut off at the cutting position 124 is continuously discharged from the paper discharge port 33 and a remaining portion 4B is placed at the paper feed passage 16 of the cutting apparatus 4.

Figure 11:
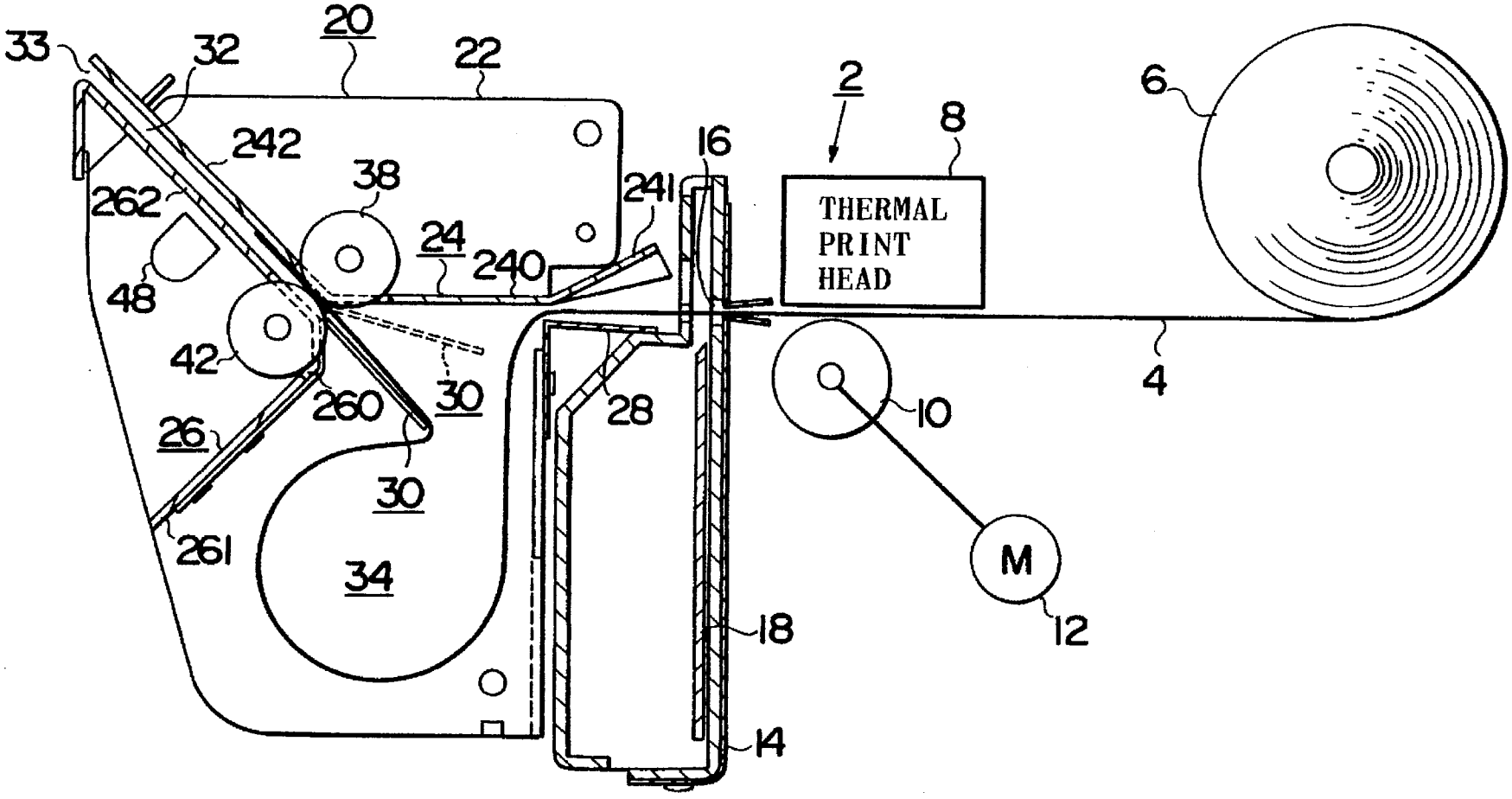
FIG. 11 is a cross-sectional view of the paper discharge apparatus showing a state where the paper is stored during printing.

The printing operation and the feeding operation will be described hereinafter with reference to FIGS. 11 to 13.

When the paper 4 is clamped and fed by the discharge rollers 38 and 42 which are rotated by the motor 52, the leading end of the paper 4 reaches under the paper detection sensor 48 where it is detected by the paper detection sensor 48. At this time, the motor 52 is stopped so that the paper 4 is clamped and held by the discharge rollers 38 and 42. That is, the discharge rollers 38 and 42 are in standby condition. At this time, the printing operation is continuously performed anal the paper 4 is fed by the platen 10. The cutting apparatus 14 is also in the standby condition at this time. Accordingly, the paper 4 is fed on the paper feed passage 16 in synchronization with the printing operation and fed into the space portion 34. That is, when the paper 4 is fed into the space portion 34 while the leading end thereof is held by the discharge rollers 38 and 42, it makes a loop inside the space portion 34 and is kept inside the space portion 34 as shown in FIG. 11.

When the printing operation is completed and successively the feeding operation by m lines is completed, the cutting apparatus 14 operates. The cutter blade 18 lowers thereby cutting off the paper 4. Upon completion of the paper cutting operation, the cutter blade 18 retracts.

Figure 12:
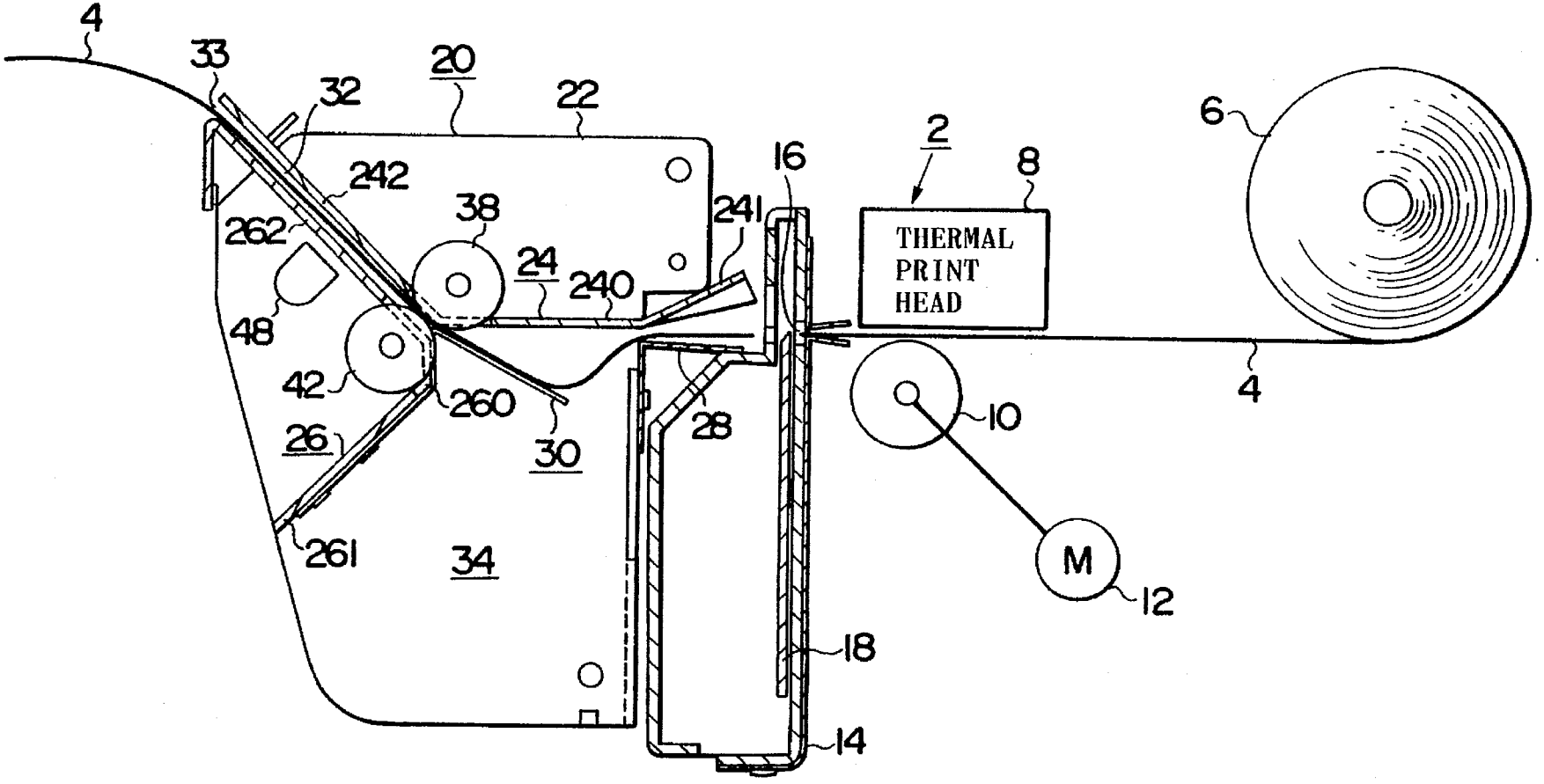
FIG. 12 is a cross-sectional view of the paper discharge apparatus showing another state where the paper is stored during printing.

When the motor 52 is driven after the paper 4 is cut off, as shown in FIG. 12, the paper is guided toward the paper discharge port 33 along the paper discharge passage 32 by the rotation of the discharge rollers 38 and 42, then it is successively discharged. When a trailing end of the paper 4 is moved away from an area where the paper 4 is to be detected by the paper detection sensor 48, a detecting output representing the completion of the discharge of the paper is produced by the paper detection sensor 48, which is supplied to the control portion 100. As a result, the motor 52 is stopped and the paper discharging operation is completed. The cut paper 4 is issued as receipts or tickets so as to be received by the recipient.

Figure 13:
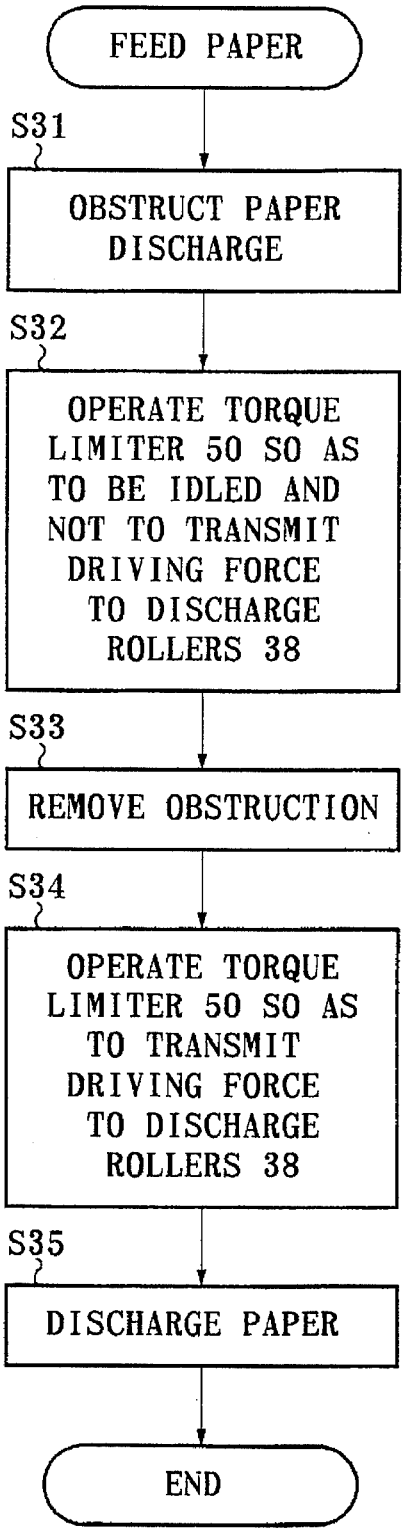
FIG. 13 is a flow chart showing an operation when the paper is prevented from being discharged.

FIG. 13 shows an operation of the paper discharge apparatus in a case where the paper 4 is prevented from being discharged, namely in such a case that the paper discharge port 33 is blocked. In step S31, for example, when the paper discharge port 33 is blocked so that the delivery of the paper 4, i.e. discharge of the paper 4 is prevented, stress applied to the paper 4 acts upon the torque limiter 50 as shown in step S32 so that the torque limiter 50 idles, thereby stopping the rotation of the discharge rollers 38 and 42. As a result, the paper discharging operation is stopped. As shown in step 33, when the blocked condition of the paper is removed, a release of stress acts upon the torque limiter 50 leading to returning to a normal torque transmission condition as shown in step S34 so that the paper 4 is discharged normally as shown in step S35.

With the provision of the torque limiter 50, the driving force, which does not influence printing accuracy of the printer 2, can be set to the discharge rollers 38. Furthermore, if the feeding speed of the paper 4 from the printer 2 is not the same as the discharging speed of the paper, force involved in the discharge of the paper can be absorbed by the torque limiter 50, thereby preventing the paper from being jammed beforehand.

Figure 14:
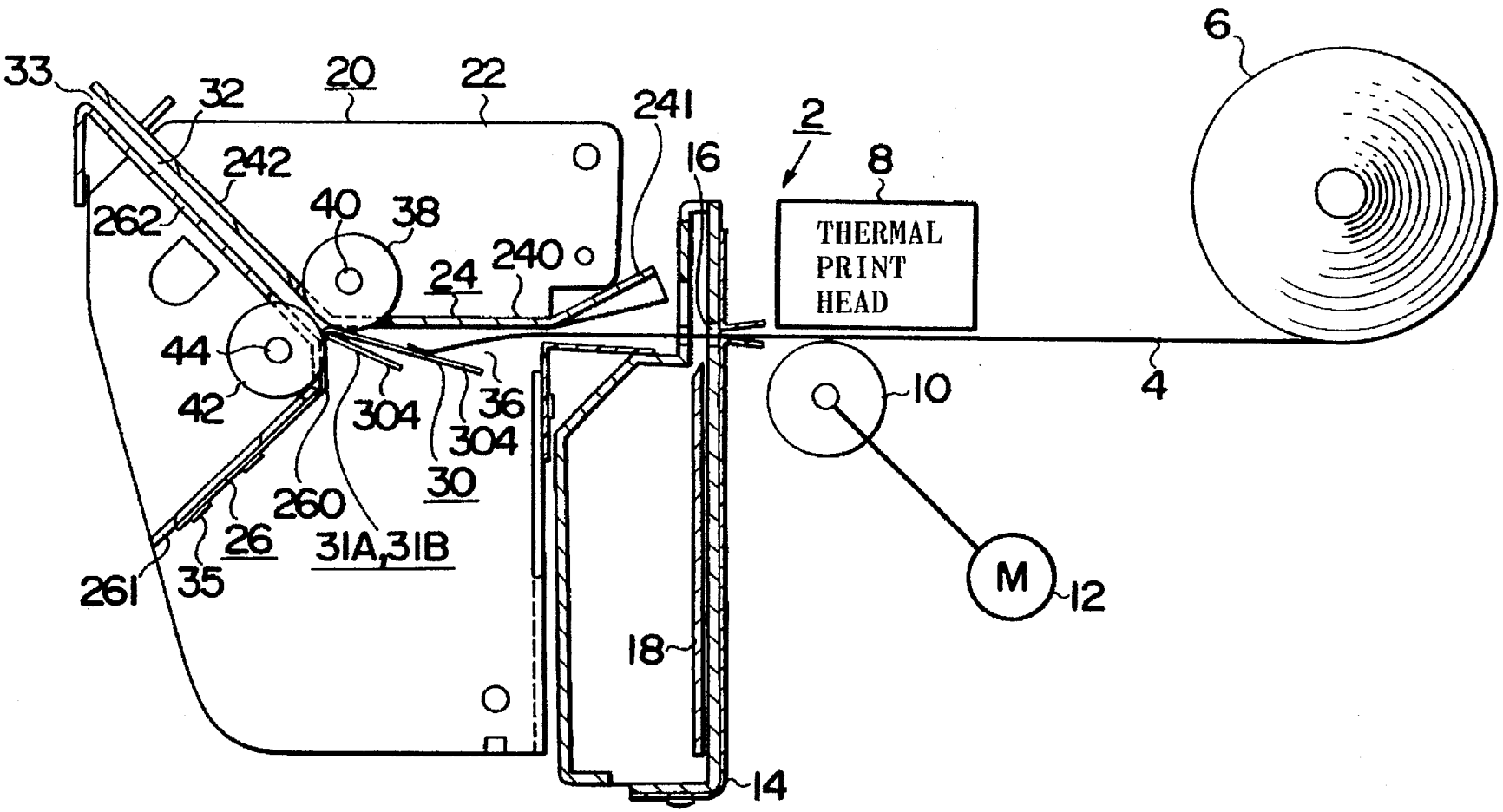
FIG. 14 is a view of a paper discharge apparatus according to a second embodiment of the present invention.
Figure 15:
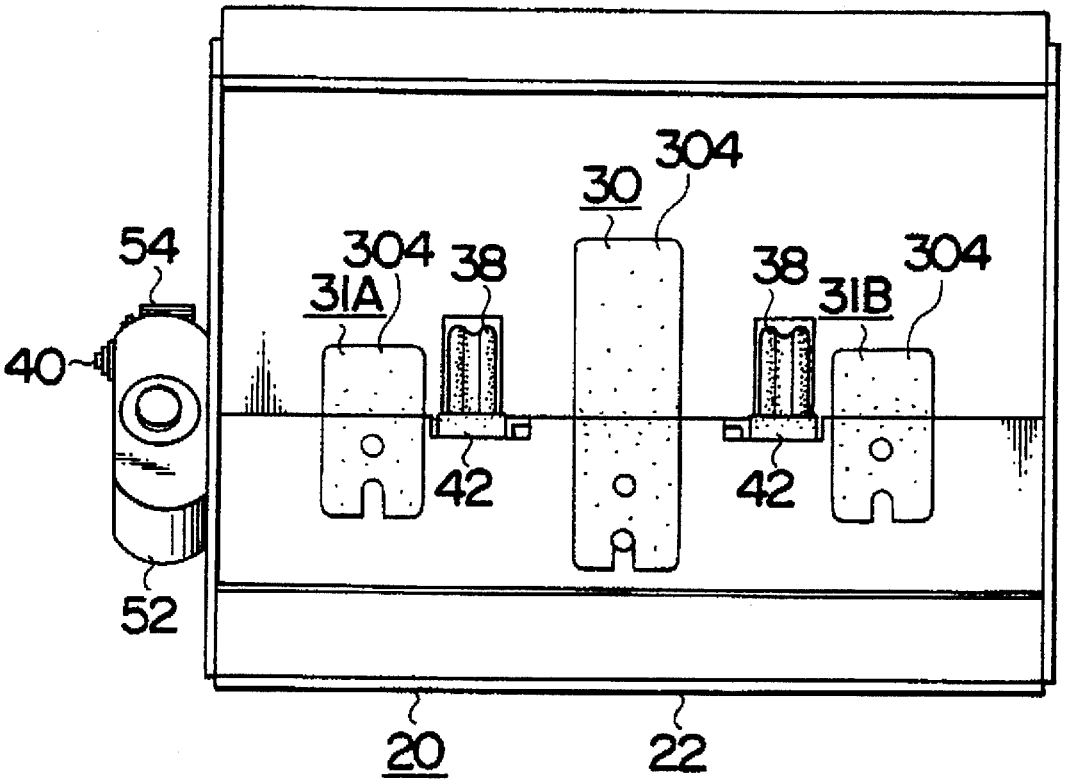
FIG. 15 is a rear view of the paper discharge apparatus in FIG. 14.
Figure 16:
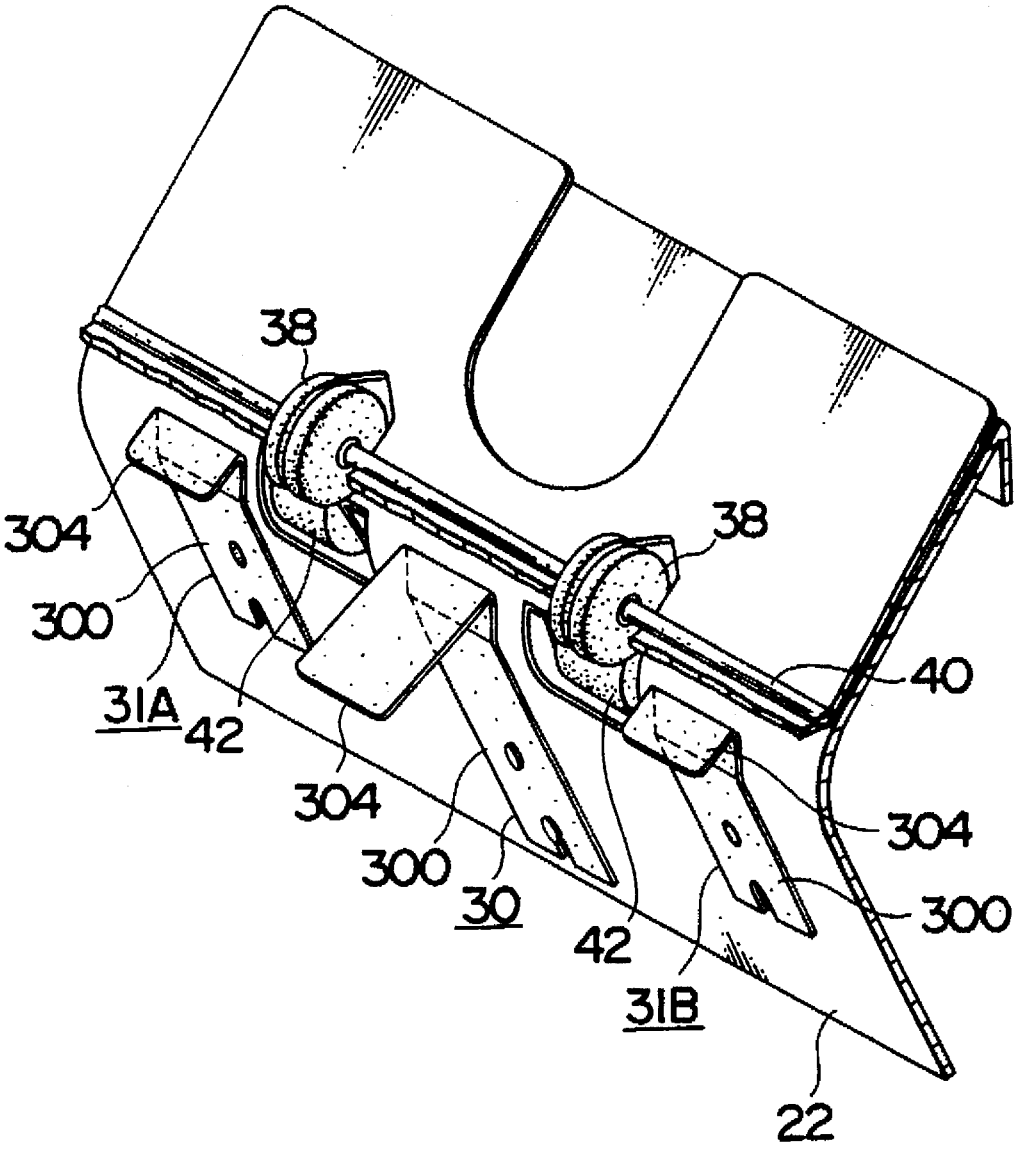
FIG. 16 is a partially perspective view of the paper discharge apparatus in FIG. 4 viewing from the rear side thereof.

Second Embodiment (FIGS. 14 through 16)

A paper discharge apparatus according to a second embodiment will be described with reference to FIGS. 14 through 16.

In the first embodiment, a single guide piece 30 is provided between a pair of discharge rollers 38 and 38 so as to guide a central portion of the paper 4 to be discharged. The shape and number of the guide piece 30 as a guide means may be arbitrary, and hence the number of the guide piece 30 may be single or plural. It is a matter of course that the shape of the guide piece 30 may correspond to a width and quality of paper, e.g. particularly, when there is a high possibility that the paper is softened by moisture.

In the second embodiment, the guide piece 30 which is the same as that of the first embodiment is disposed at the center between the discharge rollers 38 and 38, and additional guide pieces 31A and 31B are disposed at outer sides of the discharge rollers 38 and 38 using a fixing means such as an adhesive. Each of the guide pieces 31A and 31B has also a guide portion 304 which is shorter than that of the guide piece 30 so as to set a smaller angle defined between itself and the paper 4 to be discharged.

Provision of the guide pieces 31A and 31B has the following functions.

The paper 4 to be discharged first strikes against the guide piece 30 having the long guide portion 304 at the leading end thereof. Feeding force of the paper 4 presses the guide piece 30, and weight of the paper 4 is received by the guide piece 30 so that the guide piece 30 is gently bent. As a result, when the guide portion 304 of the guide piece 30 is deformed until the surface of the guide portion 304 is made flush with the surfaces of the guide portions 304 of the guide pieces 31A and 31B, the surface of the paper 4 at the side thereof strikes against the guide pieces 31A and 31B so that the paper 4 is prevented from being deformed toward the side thereof, both edges of the paper 4 are guided along the guide pieces 31A and 31B, and finally the paper 4 is surely fed to the discharge rollers 38 and 38 as the discharge means, which enhances reliability of the discharging operation.

In the first and second embodiments, the printer employing the thermal print head for printing the heat sensitive paper is explained. However, the paper discharge apparatus of the present invention can be applied to a printer employing an ink ribbon for printing an ordinary paper, and hence the present invention is not limited to the aforementioned embodiments.

The following effects can be obtained according to the first and second aspects of the present invention.

a. Since the paper to be discharged is surely guided by the guide means toward the discharge means, the paper can be smoothly discharged.

b. Even if the leading end of the paper to be discharged is bent in a loop shape, the paper can be surely guided by the guide means toward the discharge rollers, so that the paper 4 can be stably discharged. Particularly even if the roll paper has a curling property or the paper is deformed due to the pressure by the rollers at the feeding means, or the paper is softened by moisture, the paper can be surely and smoothly delivered, thereby enhancing stability of the feeding operation, surely preventing the conventional paper jam, and enhancing reliability of the paper discharging operation.

c. Since the guide means employs the elastic guide piece, the paper to be discharged can be guided with a simple structure.

d. The shape and number of the guide piece can be arbitrarily set corresponding to the paper to be discharged, thereby enhancing reliability of the paper discharging operation.

Although the present invention is explained with reference to the first and second embodiments, it is not limited to these embodiments but includes various modifications for realizing the object of the present invention.

What is claimed is:

1. A paper discharge apparatus provided in a paper discharge portion of an equipment such as a printer for discharging paper comprising:

a pair of discharge rollers for receiving the paper to be discharged and discharging the paper;

a space portion for storing the paper which is looped by being clamped by the pair of discharge rollers as the paper is delivered therein;

guide means for guiding a leading end of the paper introduced into the space portion to the pair of discharge rollers, and for looping the paper inside the space portion when said guide means is deformed depending on the flexure of the paper caused by delivery of the paper into the space portion;

a paper discharge passage for guiding the paper delivered by the pair of discharge rollers; and a guide piece made of elastic material extending from a portion adjacent the pair of discharge rollers provided at the paper discharge passage to the space portion, said guide piece receiving a leading end of the paper to be delivered thereby, guiding the paper to the pair of discharge rollers, and looping the paper clamped by the pair of rollers at the leading end thereof inside the space portion as the guide piece is bent depending on the flexure of the paper caused by the delivery of the paper into the space portion.

2. A paper discharge apparatus according to claim 1, wherein the guide piece is single or plural in number and is disposed along a paper feed passage of the paper.

3. In a printer, a paper discharge apparatus for discharging paper which is printed by the printer, the paper discharge apparatus comprising:

feeding means for feeding paper along a paper feed passage;

a pair of discharge rollers for receiving the paper to be fed and discharging the paper;

a space portion provided under the paper feed passage for storing the paper which is being discharged; and guide means for guiding a leading end of the paper to be fed by the feeding means to said pair of discharge rollers, said guide means being bent upon reception of flexure of the paper caused by its own weight when the paper is fed by said feeding means while the pair of discharge rollers stops with the paper clamped therebetween, said guide means thereby looping the paper inside the space portion.

4. The paper discharge apparatus according to claim 3, wherein the guide means comprise a guide piece made of elastic material and projecting from a portion adjacent the pair of discharge rollers to the space portion with an inclination, said guide piece being bent upon reception of a load of the paper caused by its own weight when the paper is fed.

5. The paper discharge apparatus according to claim 3, wherein the guide piece comprises a single piece or a plurality of pieces.

6. The paper discharge apparatus according to claim 4, wherein the guide piece comprises a single piece or a plurality of pieces.

* * * * *